US005652995A

United States Patent [19]

Henke et al.

[11] Patent Number: 5,652,995

[45] Date of Patent: Aug. 5, 1997

[54] NOZZLE FOR LAWN AND GARDEN BLOWER

[75] Inventors: Fred G. Henke; Donald M. Woods; Michael S. Houge, all of Shreveport, La.

[73] Assignee: WCI Outdoor Products, Inc., Cleveland, Ohio

[21] Appl. No.: 507,904

[22] Filed: Jul. 28, 1995

[51] Int. Cl.[6] ..... A47L 5/12; A47L 9/08

[52] U.S. Cl. ..... 15/344; 15/405; 15/415.1

[58] Field of Search ..... 15/405, 415.1, 15/420, 422.1, 406, 407, 408, 330, 344, 414; 34/96, 97, 98

[56] References Cited

U.S. PATENT DOCUMENTS

| | | | |
|---|---|---|---|
| 933,003 | 8/1909 | Smith | 15/415.1 |
| 933,526 | 9/1909 | Brown | 15/405 |
| 963,049 | 7/1910 | Kenney | 15/415.1 |
| 1,005,290 | 10/1911 | Overholt | 15/405 |
| 1,136,434 | 4/1915 | Overholt | 15/405 |
| 2,753,434 | 7/1956 | Storm, Jr. | 15/330 |
| 3,009,188 | 11/1961 | Martin | 15/330 |
| 3,134,128 | 5/1964 | Campbell | 15/422 |
| 3,837,581 | 9/1974 | Orsoff | 34/97 |
| 4,037,667 | 7/1977 | Gonsalves et al. | 15/403 |
| 4,132,507 | 1/1979 | Akiyama et al. | 15/405 |
| 4,700,426 | 10/1987 | McElroy | 15/415.1 |
| 4,734,017 | 3/1988 | Levin | 15/405 |
| 4,884,314 | 12/1989 | Miner et al. | 15/405 |
| 5,103,577 | 4/1992 | Michaels et al. | 34/98 |
| 5,251,281 | 10/1993 | Fravel, Jr. | 15/405 |

FOREIGN PATENT DOCUMENTS

| | | | |
|---|---|---|---|
| 178760 | 11/1906 | Germany | 15/422 |
| 606036 | 8/1948 | United Kingdom | 15/405 |

*Primary Examiner*—Tony G. Soohoo

*Attorney, Agent, or Firm*—Marc A. Hubbard; Winstead Sechrest & Minick P.C.

[57] ABSTRACT

A nozzle for use with a lawn and garden blower provides a comparatively wide pattern of high velocity air. The nozzle includes a substantially hollow, tubular housing tapering from the upstream end to the downstream end. At the downstream end is a plurality of bores arranged side-by-side to divide the air stream into a plurality of high velocity air streams substantially parallel to one another as the plurality of air streams exit the nozzle from a plurality of apertures proximate the downstream end.

9 Claims, 3 Drawing Sheets

NOZZLE FOR LAWN AND GARDEN BLOWER

TECHNICAL FIELD

This invention relates to the field of powered lawn care equipment. Specifically, it relates to nozzles for controlling air flow from lawn and garden blowers.

BACKGROUND OF THE INVENTION

Devices known generally as lawn, garden or pavement blowers have been aiding domestic and commercial yard maintenance for many years. Although there are a number of brands and models on the market, the value of any given blower depends on only a few characteristics, the most important of which are price, weight and of course how effectively they propel leaf litter and debris. These three characteristics are related. The more powerful the blower motor, the heavier and more expensive an individual device will tend to be. The weight of the unit can become an important factor after a prolonged period of use. Therefore, it is desirable to maximize air flow efficiency so that a blower with a given motor can perform the greatest amount of work for its weight and cost.

High air velocity is generally viewed as desirable in yard and pavement sweeping applications. However, in order to maximize air velocity, the flow of air must be concentrated by a nozzle having, for example, a smaller, generally circular opening. While a concentrator nozzle has had the desired effect of increasing air velocity, the resulting air jet is narrow and thus does not efficiently sweep or clear a wide area, and, in fact, creates turbulent air flows in the vicinity that tends to blow leaves back at the operator. To provide a wider pattern of air generally parallel to the ground, the nozzle opening is made wider a direction parallel to the ground, and narrower in a direction perpendicular to the ground. In other words, the opening is formed in the shape of a slot. However, a slot shaped opening is comparatively inefficient and causes a substantial loss of velocity.

SUMMARY OF THE INVENTION

According to the invention, a lawn and garden blower has a nozzle which provides a comparatively wide pattern of high velocity air. At the exit of the nozzle, there are a plurality of high-efficiency tubular-shaped bores, arranged side-by-side, which divide the airstream entering the nozzle into a plurality of high-velocity air jets substantially parallel to each other. The air jets, after exiting the nozzle, collectively form a wide pattern of high velocity air suitable for yard and pavement sweeping and clearing.

DETAILED DESCRIPTION OF THE INVENTION

Figure 1:
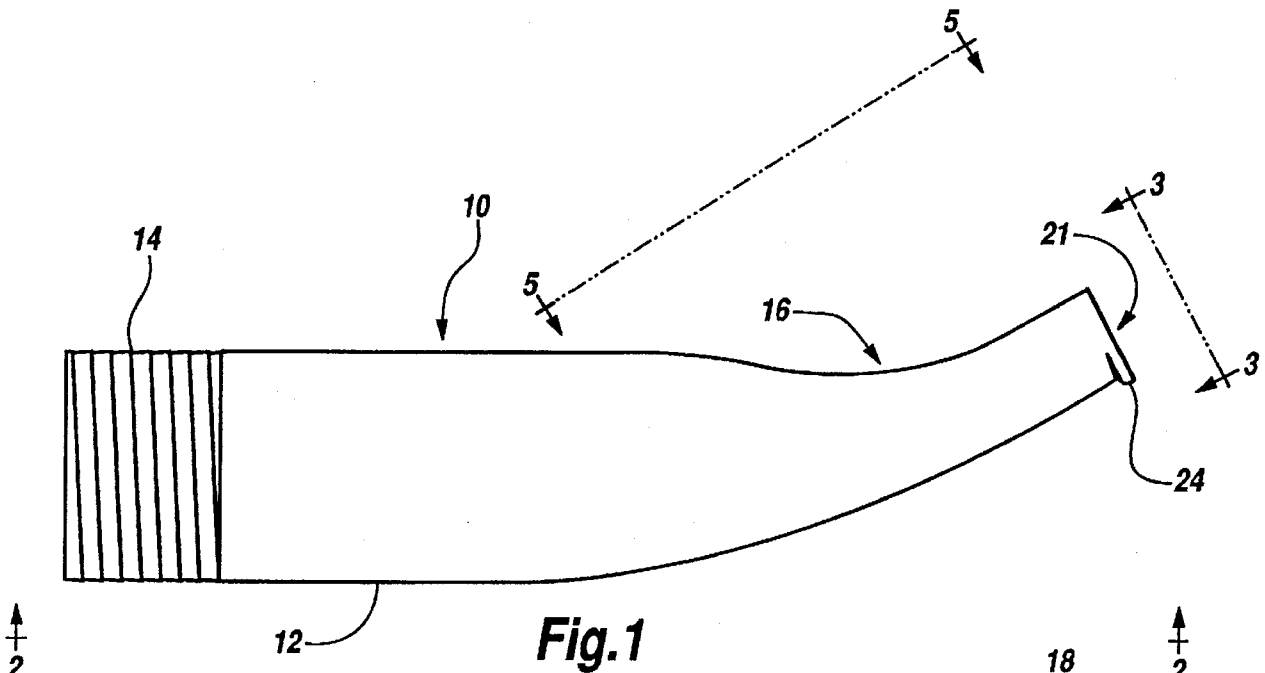
FIG. 1 is a side view of nozzle for expelling air from a lawn and pavement blower.
Figure 6:
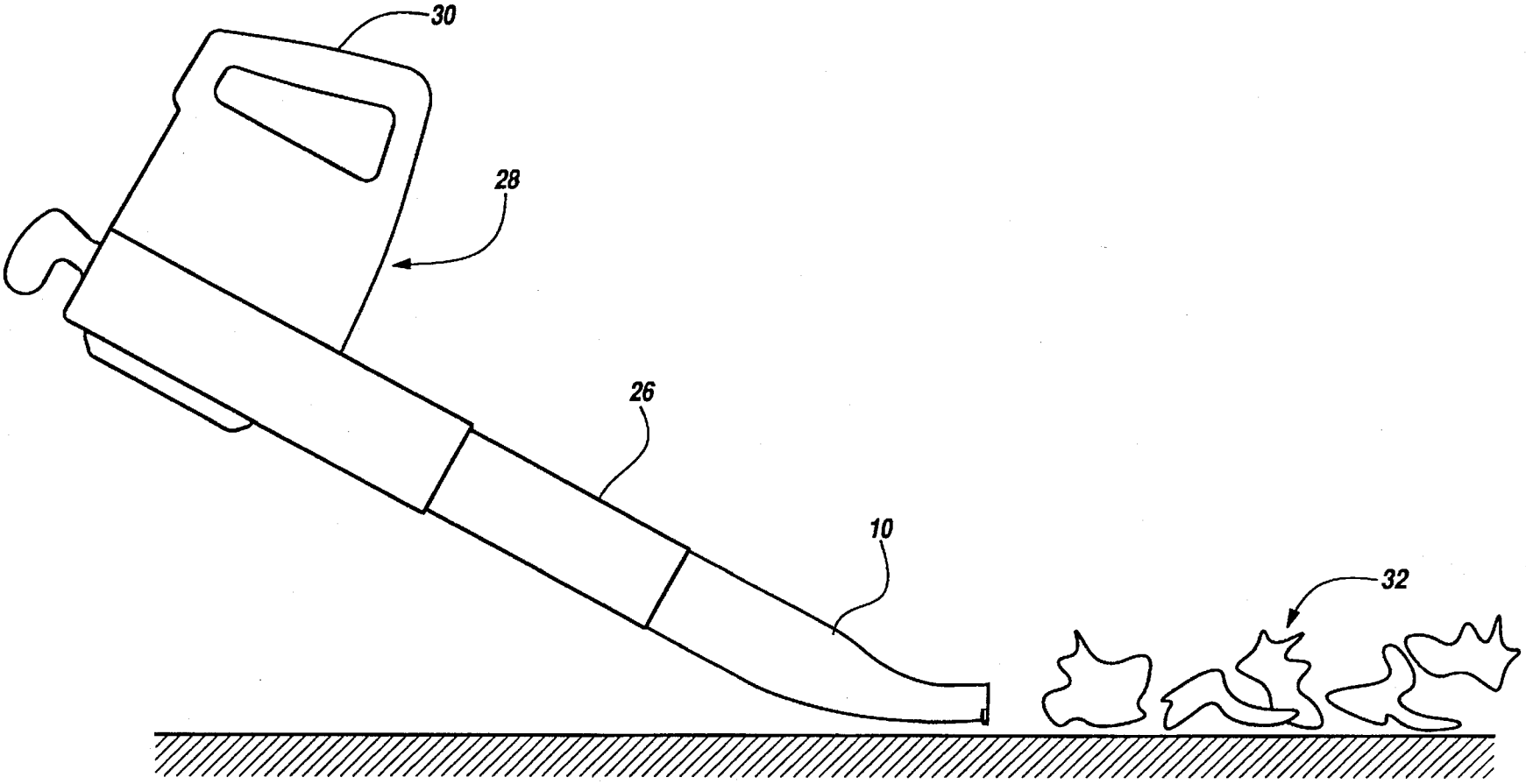
FIG. 6 is a side view of a leaf blower with a nozzle according to the invention.

Referring now to the drawings and particularly to FIG. 1, there is shown the lateral view of a nozzle 10 for directing and increasing the velocity of air. The nozzle 10 includes a hollow tube 12 which has threads 14 at the upstream end of the nozzle 10 for connecting the nozzle to a blower tube. As will be appreciated, other connection means can be utilized by those skilled in the art. These include, but are not limited to, interlocking connections which snap and unsnap, clamp type connectors, etc. Referring to FIG. 6, the nozzle 10 attaches to the blower tube 26 which directs air from the leaf blower 28. Handle 30 enables the blower to be held above the ground 32. Referring again to FIG. 1, the tube 12 has a converging tapered section 16 leading to a plurality of bores 18, each having an aperture 20. Collectively, the apertures comprise the downstream exit point 21. Preferably, the shape of each of the apertures 20 is generally circular to optimize efficiency. The axes of the bores are oriented such that they are substantially parallel to one another and lie within a common plane. The plane in which each aperture 20 lies is substantially normal to the axis of its bore. The bores divide the air flow entering the nozzle into a plurality of high velocity streams, thus better dispersing the air flow over a wider area to enhance clearing while maintaining high-velocity for use in dislodging heavier objects.

Figure 2:
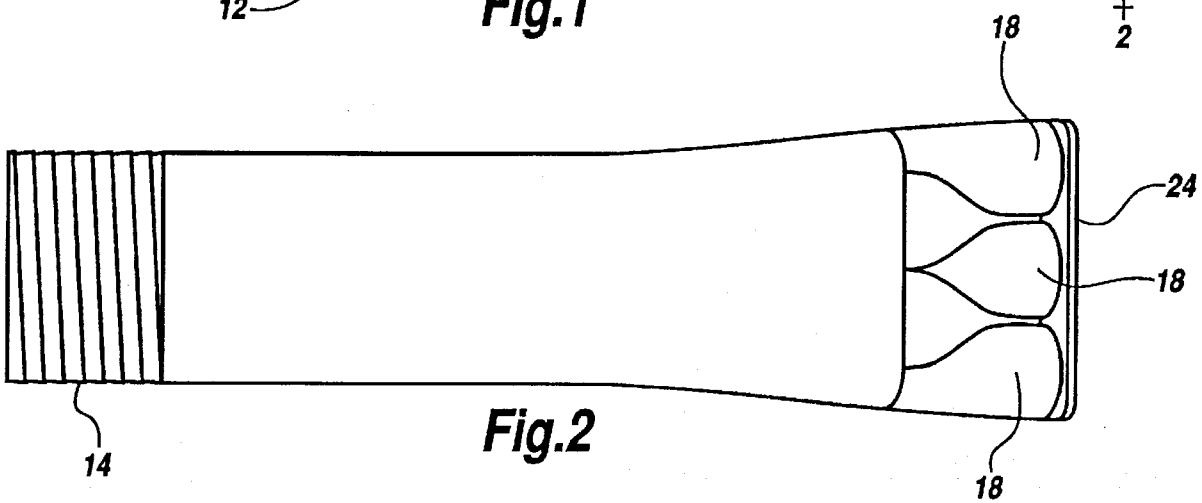
FIG. 2 is a bottom view of the nozzle shown in FIG. 1.
Figure 5:
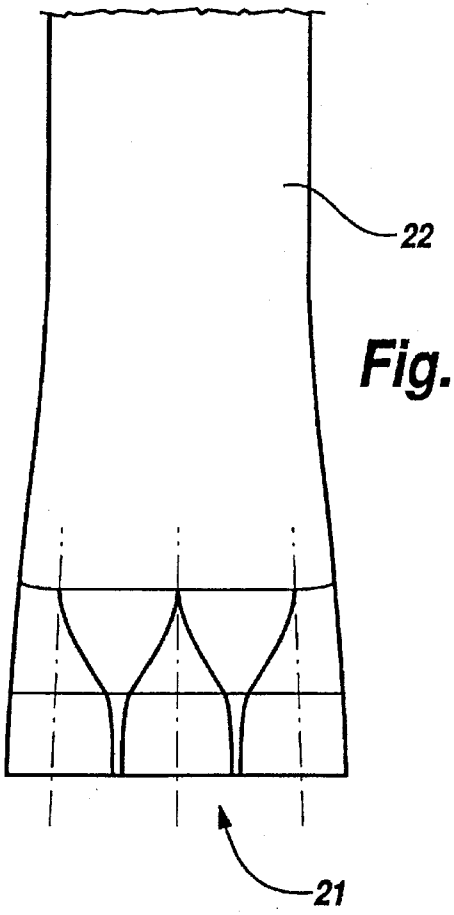
FIG. 5 is a top view of the nozzle shown in FIG. 1.
Figure 4:
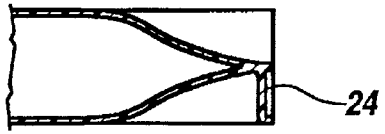
FIG. 4 is a section view taken along line 4—4 of FIG. 3.
Figure 3:
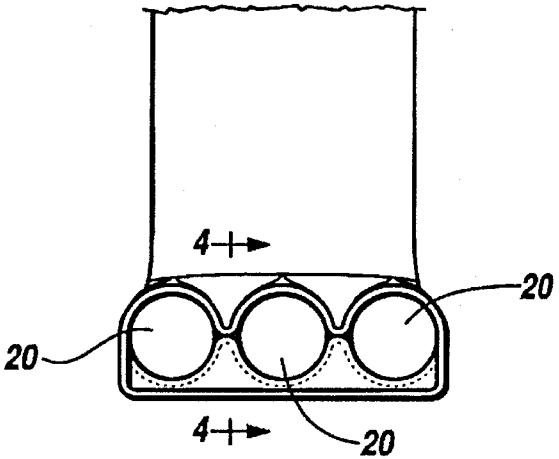
FIG. 3 is a section view taken along line 3—3 of FIG. 1.

Now referring to FIG. 2, the nozzle 10 has an integrated reverse dorsal/ventral taper or flare 22 in the downstream direction (also shown in FIG. 5). Also included in the preferred embodiment is a flange 24. The flange 24 functions as a scraping blade and wear protector for the bottom of the nozzle 10 and for the sides. The nozzle 10 also could include the tapered section 16 having a curved shape extending from the top of the nozzle 10 so as to direct the air in a more horizontal relationship to the ground.

Although the foregoing invention has been described in some detail by way of illustration and example for the purposes of understanding and clarity of understanding, it will obvious that certain changes and modifications may be practiced within the scope of the appended claims.

What is claimed is:

1. A portable powered leaf blower comprising:

a motor;

a fan driven by the motor for generating a single stream of high velocity air;

a housing in which the motor and fan are mounted, the housing including means for manually carrying the blower in an elevated position; and an elongated, hollow tube having a first end coupled to the housing for receiving the single stream of high velocity air from the fan and a second end including a nozzle for discharging the high velocity air, the nozzle having a terminating end portion wherein there is defined a plurality of bores lying side-by-side in a common plane for dividing the single stream of air into a plurality of substantially parallel, side-by-side high-velocity air streams, each of the bores having a diameter smaller than that of the conduit.

2. The blower in accordance with claim 1 wherein each of the plurality of bores has an axis and whereby the plurality of bores are oriented such that the axes of the bores are substantially parallel to one another and lie substantially within a common plane.

3. The blower in accordance with claim 1 wherein each of the bores has a substantially circular cross-section.

4. The blower in accordance with claim 1 wherein the downstream end of the nozzle further includes a blade disposed on a bottomside of the nozzle, for scraping objects along the ground.

5. The blower in accordance with claim 1 wherein the nozzle curves such that the bores lie in a common plane substantially parallel to the ground for directing the discharge of the plurality of air streams in a direction substantially parallel to the ground when a user manually carries the blower in a normal, elevated operating position by the means for carrying.

6. A portable powered leaf blower comprising:

a motor;

a fan driven by the motor for generating a stream of high velocity air;

a housing in which the motor and fan are mounted, the housing including means for manually carrying the blower in an elevated position; and an elongated conduit means having a first end coupled to the fan for receiving the stream of high velocity air from the fan, a second end including a nozzle having defined in a terminating end thereof a plurality of bores for dividing the stream of air into a plurality of substantially parallel, side-by-side air streams;

wherein the nozzle curves such that the bores are aligned for directing the discharge of the plurality of air streams in a direction substantially parallel to the ground when a user manually carriers the blower in a normal, elevated operating position by the means for manually carrying.

7. The blower in accordance with claim 6 wherein each of the plurality of bores has axis and whereby the plurality of bores are oriented such that the axes of the bores are substantially parallel to one another and lie substantially within a common plane.

8. The blower in accordance with claim 6 wherein each of the bores has a substantially circular cross-section.

9. The blower in accordance with claim 6 wherein the downstream end of the nozzle further includes means, extending from the nozzle, for scraping objects along the ground.

* * * * *

UNITED STATES PATENT AND TRADEMARK OFFICE

CERTIFICATE OF CORRECTION

PATENT NO. : 5,652,995

DATED : August 5, 1997

INVENTOR(S) : Fred G. Henke, et al.

It is certified that error appears in the above-identified patent and that said Letters Patent is hereby corrected as shown below:

Col. 1, line 36, "wider a" should read --wider in a--

Col. 2, line 35, "will" should read --will be--

Col. 4, line 4, "carriers" should read --carries--

Col. 4, line 8, "has axis" should read --has an axis--

Signed and Sealed this

Thirtieth Day of June, 1998

*Attest:*

*Attesting Officer*

Bruce Lehman

BRUCE LEHMAN

*Commissioner of Patents and Trademarks*